US005836099A

United States Patent [19]

Pace et al.

[11] Patent Number: 5,836,099

[45] Date of Patent: Nov. 17, 1998

[54] ROD ASSEMBLY AND METHOD

[76] Inventors: Chriss L. Pace, 842 S. Tamela Dr.; Curtis B. Guillory, 910 S. Tamela Dr., both of Lake Charles, La. 70605

[21] Appl. No.: 869,664

[22] Filed: Jun. 5, 1997

[51] Int. Cl.[6] ..... F41A 29/02

[52] U.S. Cl. ..... 42/95; 42/90

[58] Field of Search ..... 42/95, 90; 15/220.4

[56] References Cited

U.S. PATENT DOCUMENTS

| | | | |
|---|---|---|---|
| 707,913 | 8/1902 | Garrison | 42/95 |
| 860,180 | 7/1907 | Aird | 42/95 |
| 1,665,988 | 4/1928 | Smith | 15/104.165 |
| 3,208,302 | 9/1965 | Lewis et al. | 74/548 |
| 3,286,293 | 11/1966 | Eckert | 15/104.16 |
| 4,803,792 | 2/1989 | Brown, Jr. et al. | 42/95 |
| 4,843,747 | 7/1989 | Echeberria | 42/90 |
| 4,862,623 | 9/1989 | Delap et al. | 42/90 |
| 4,901,465 | 2/1990 | Hsu | 42/95 |
| 5,075,998 | 12/1991 | Seller | 42/95 |
| 5,127,179 | 7/1992 | Marsh | 42/90 |
| 5,404,666 | 4/1995 | Cline, Jr. | 42/90 |
| 5,588,242 | 12/1996 | Hughes | 42/95 |

*Primary Examiner*—Charles Jordan
*Assistant Examiner*—Meena Chelliah
*Attorney, Agent, or Firm*—Jack E. Dominik

[57] ABSTRACT

A muzzle loader rod assembly of the present invention is an elongate sectioned rod, preferably made of brass is disclosed. At one remote end of the rod, a slide telescopingly surrounds the rod and is removably secured thereto by means of a set screw or similar fastener to prevent rattling when the product is in the field and to further secure the parts together. A wide variety of tools can be secured to the end of the ramrod accessory tamper portion and coupler including bullet removers, patch removers, tampers, cleaning tools, brushes, and the like. In use for bullet removal, the bullet removal member is secured to one end of the accessory tamper end of the rod, and then tapped in place by dropping the reciprocating slide. No particular real strength is required to do this. When the bullet extractor is removed, the accessory coupler becomes a tamper. The bullet tamped into the powder with an empirically determined number of strokes of the dropped slide which imparts uniformity of tamping to each charge.

7 Claims, 4 Drawing Sheets

ROD ASSEMBLY AND METHOD

BACKGROUND OF THE INVENTION

The present invention relates to a multi-purpose tool for use in servicing a muzzle loading firearm, whether a rifle, pistol, or other denominated weapon.

FIELD OF THE INVENTION

One problem with muzzle loading firearms occurs when the bullet is stuck in the chamber, or the shooter wants to remove the bullet for any particular reason. Bullet pullers do exist, such as a threaded member, which can be applied to the end of a ramrod. Moreover, when the bullet is firmly lodged inside the barrel, a mere pull on the ramrod may not necessarily dislodge the bullet from a sharp rib on the inner walls of the rifling. Also, when the typical ramrod is employed with a bullet puller, the temptation for the rifleman to point the muzzle of the gun at himself to maximize the pull on the ramrod always exists. Finally, in many instances when the bullet becomes lodged in the rifle barrel, and the ramrod and puller will not remove the bullet, the rifleman must abandon his rifle for the balance of the day until he can take it to a shop where either the rifle is disassembled, or the ramrod is pulled outwardly by force other than by hand. In addition, in tamping a bullet in place on powder, the loading process, if painstakingly uniform will result in relatively uniform trajectory of the bullet from shot to shot. In addition the muzzle velocity, thereby maintaining the momentum in the bullet for maximum killing power, is optimized. To date, the foregoing problems in their entirety which beset the muzzle loading shooter have not been addressed in a single tool.

SUMMARY OF THE INVENTION

The muzzle loader rod assembly of the present invention is an elongate sectioned rod, preferably made of brass. At one remote end of the rod, a slide telescopingly surrounds the rod and is removably secured thereto by means of a set screw or similar fastener to prevent rattling when the product is in the field and to further secure the parts together. A wide variety of tools can be secured to the end of the ramrod accessory tamper portion and coupler including bullet removers, patch removers, tampers, cleaning tools, brushes, and the like. In use for bullet removal, the bullet removal member is secured to one end of the accessory tamper end of the rod, and then tapped in place by dropping the reciprocating slide. No particular real strength is required to do this. When the bullet extractor is removed, the accessory coupler becomes a tamper. The bullet tamped into the powder with an empirically determined number of strokes of the dropped slide which imparts uniformity of tamping to each charge.

In view of the foregoing, it is a principal object of the present invention to provide a tool for servicing muzzle loading firearms which utilizes the momentum of a slide to uniformly apply the impact load to an engaged bullet to remove the same from its place of lodgment in the barrel of the firearm.

Another object of the present invention is to utilize the same slide, to apply a uniform amount of tamping to the bullet atop the powder charge.

Yet another object of the present invention is to utilize the subject rod assembly in the field, in cold weather when gloves are being worn, or even in hot weather when perspiration may be involved. Because of the uniformity of the tamping, no great skill is required, but rather the ability to count and apply the pressure uniformly.

Also, the slider may be removed from the rod assembly and secured to the upper end of the rod to effect the action of a long rod screw driver.

Another advantage of the present invention is to provide such a tool which will adapt to a wide variety of firearm treatment members such as cleaners, patch removers, brushes, and the like and even other ramrods. A related advantage is that such a tool can be carried in the field with the shooter available for use on short notice to service the firearm promptly and not interrupt the day's shooting.

DESCRIPTION OF ILLUSTRATIVE DRAWINGS

Further objects and advantages of the present invention will become apparent in the following description of an illustrative embodiment proceeds, taken in conjunction with the accompanying drawings in which:

FIG. 1 discloses a typical rifleman utilizing a muzzle loader rifle in the tamping, or bullet moving configuration;

DESCRIPTION OF A PREFERRED EMBODIMENT

Figure 1:
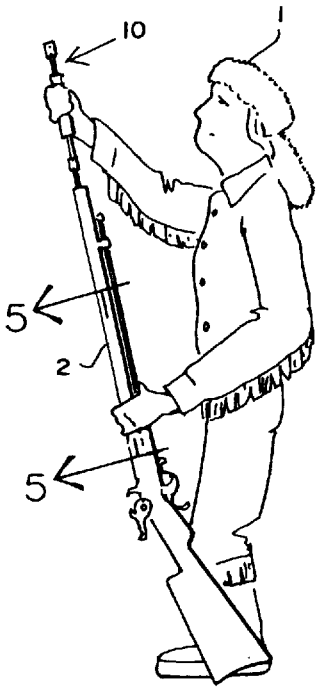
Figure 4:
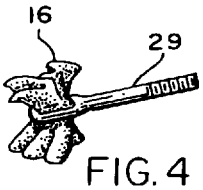
FIG. 4 shows a typical accessory in perspective which can be inserted to the lower portion of the ramrod of FIG. 2.
Figure 2:
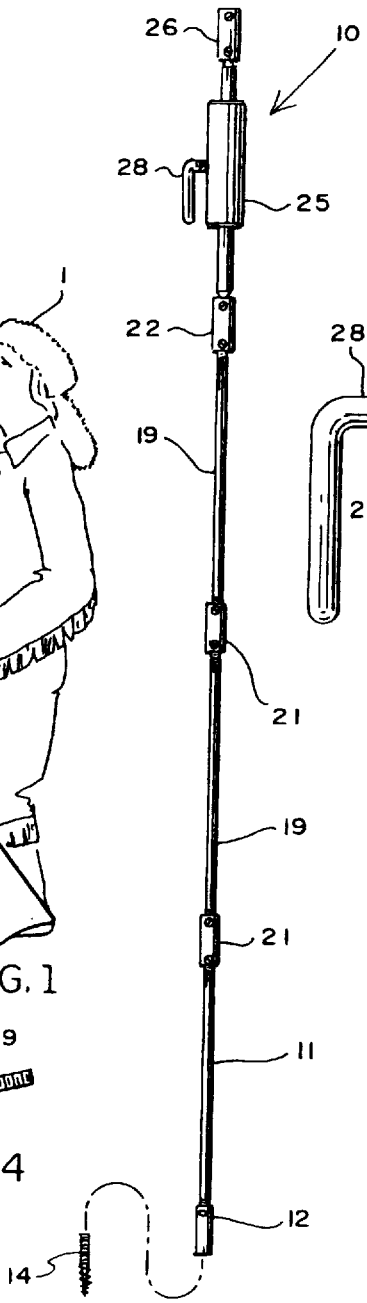
FIG. 2 is a front elevation of the rod assembly.

The present invention will be better understood by first noting FIG. 1 of the accompanying drawings, in which a rifle man 1 is shown with the subject rod assembly 10 inserted into a rifle 2. The rod assembly 10, particularly as shown in FIG. 2, includes an accessory rod 11, an accessory coupler 12. To be noted throughout the entire description, all of the threads are essentially the same, being right-hand, and the rod sections are the same diameter, one-quarter inch to three-eighths of an inch depending upon the size of the rifle or firearm involved. A swab 31 is shown in FIG. 4.

Figure 3:
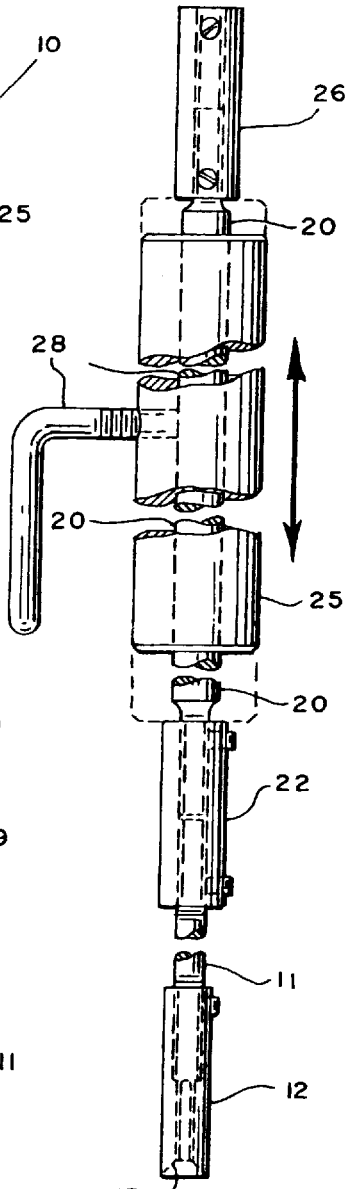
FIG. 3 is an enlarged partially broken view of the upper portion of the rod assembly shown in FIG. 2.

Turning now to FIG. 3, it will be seen that the slide rod coupler 22 is secured to the extension rod 19. Reference numeral 21 is an extension coupler for the intermediate portions of the rod assembly. The slide 25 includes a slide stop 28 in the form of an L-shaped handle. The internal diameter of the slide 25 is such that it will slide over the slide rod 20 easily. At the upper end of the slide rod 20, provision is made for a slide stop coupler 26.

Figure 10:
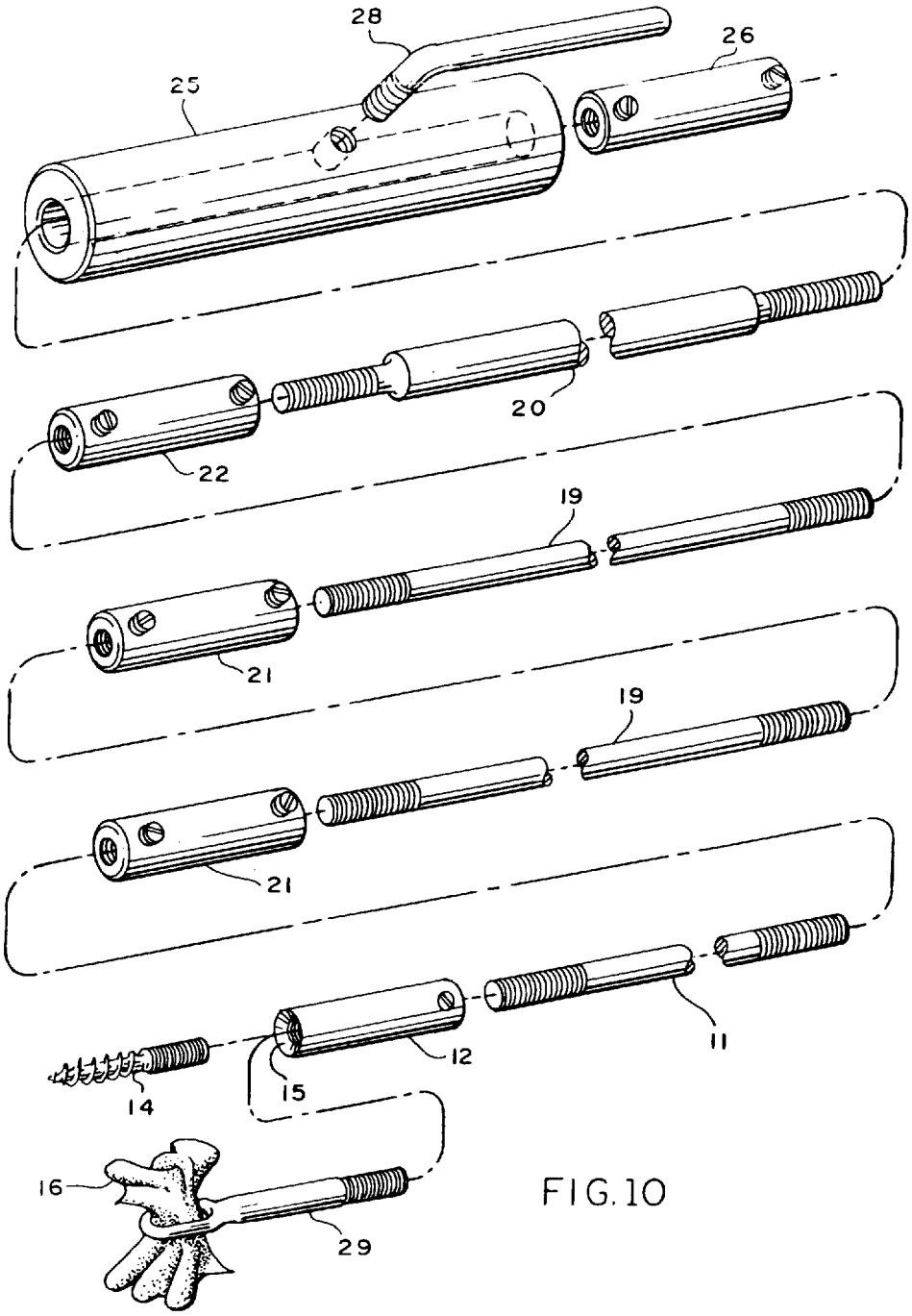
FIG. 10 is an exploded perspective view of the entire rod assembly showing the sequential elements and showing in the alternative the application of a bullet tamper, bullet extractor and a swab.

As shown in FIG. 10 the entire rod assembly 10 can be disassembled for compact storage with sections 12 to 24 inches in length. Moreover, while the accessory rod portion 11 may be of a fixed length, the extension rods 19 may be of differing lengths and differing numbers. Important, however, is consistency in the threads utilized on the rod elements and the threads used on the couplers. Desirably a 10–24 NC thread may be employed, but alternatives are contemplated. Here it should be remembered that the utilization of uniform threads are relatively inexpensive to fabricate, and render the various elements of the subject rod assembly 10 readily susceptible to in-field or at-home repair. Bayonet fastener for securing the elements together are also contemplated, but are most likely to be more expensive to fabricate as less durable in operation. Hence, where reference is made to screw threads, there is no question that other alternatives are contemplated but that the screw thread is the best-believed fastening element now available.

Figure 5:
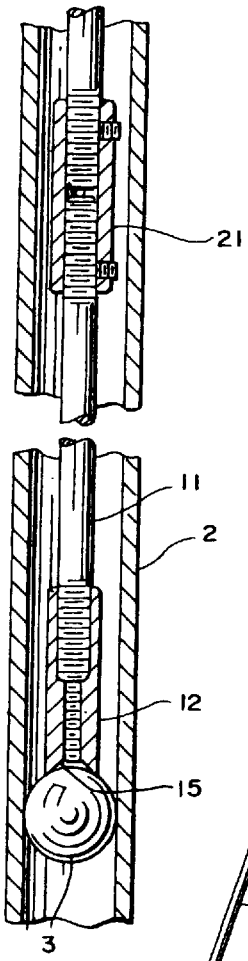
FIG. 5 is an enlarged partially broken section illustrating the ramrod with a tamp.
Figure 9:
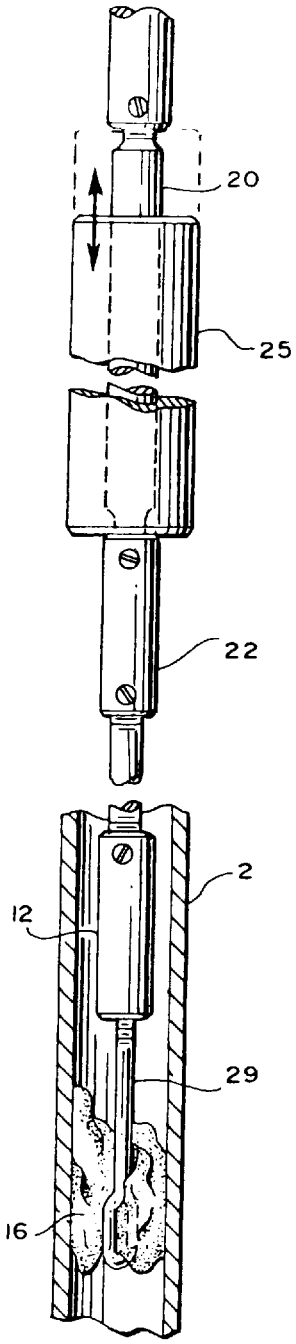
FIG. 9 is another alternative embodiment comparable to that of FIG. 4 illustrating the swab in place.
Figure 8:
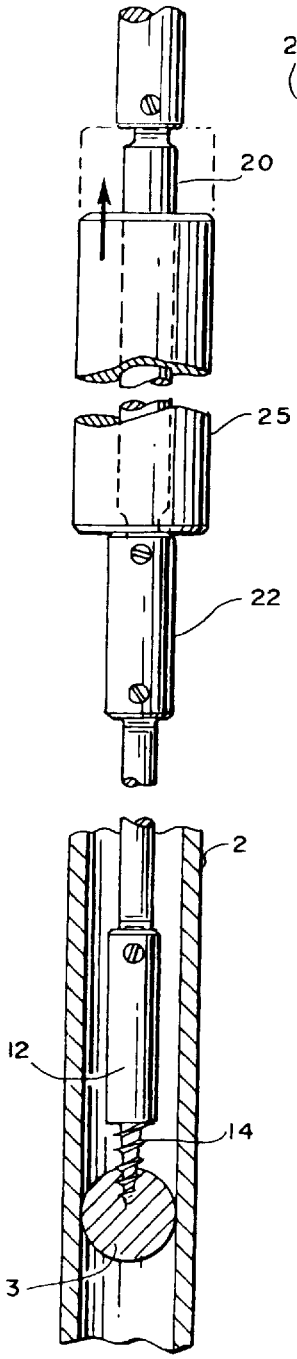
FIG. 8 is a sequential view from that of FIG. 7 but illustrating a bullet extractor being inserted into the bullet.
Figure 7:
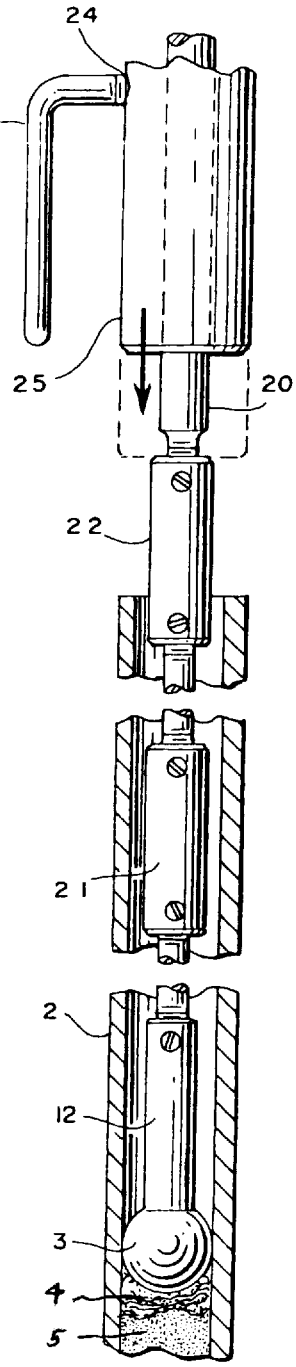
FIG. 7 is an action view of the slide urging a ball and tamping the powder charge.

As shown in FIG. 5, an accessory coupler/bullet tamper 12 is secured to the end of the accessory rod 11 and engages the bullet 3. A tamping cup 15, proportioned to tampingly engage a bullet, is provided in the extreme end of the coupler 12. FIG. 7 is somewhat more detailed showing the accessory coupler/bullet seater 12 engaging the bullet 3 which in turn is tamping a wadding 4, in compressing the powder 5. Now turning to FIG. 8, it will be seen that the bullet extractor 14 is engaging the bullet 3 having been tamped in place by use of the slide, as will be described hereinafter. Finally, noting FIG. 9, a swab 16 is secured to the end of the swab accessory 29 for cleaning the barrel of the rifle 2.

Figure 6:
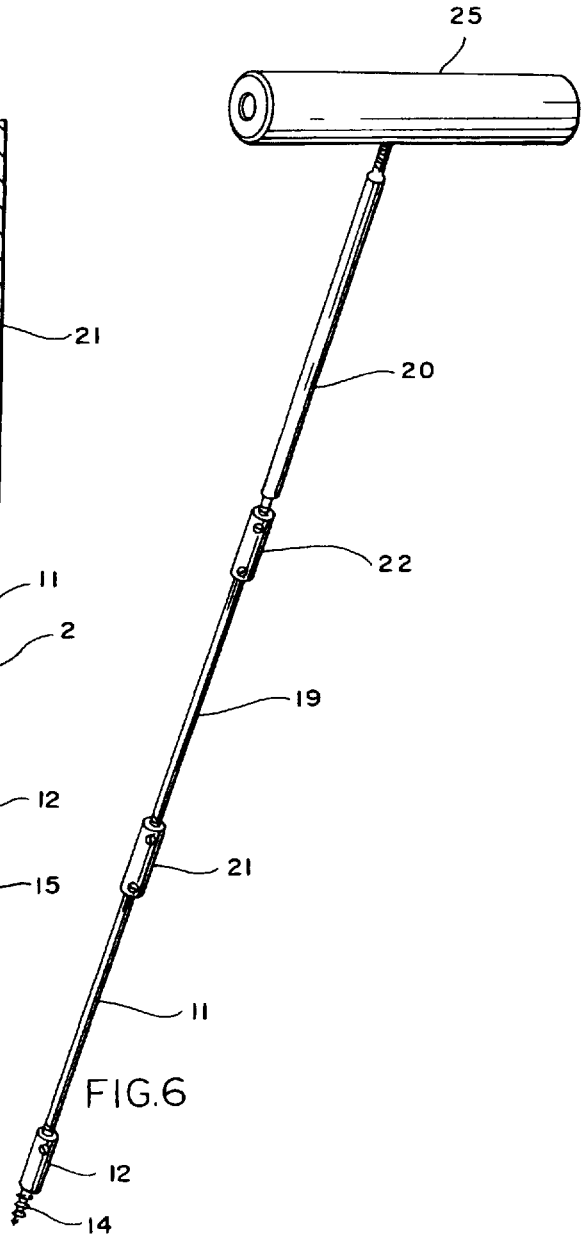
FIG. 6 is an alternative view of the rod assembly with the slider utilized as a cross-head converting the same to an elongate screwdriver.

An alternative of the subject rod assembly 10 is shown in FIG. 6. There it will be seen that the slide 25 has been removed from the slide rod 20, the L-shaped handle slide stop 28 has been removed and stored away. Since all of the threads of the couplers and the rods are right-hand, turning the same to the right makes the entire rod assembly a giant screwdriver for rotating the ball extractor, or other fixture interiorly of the barrel of the firearm.

Method

The rod assembly 10 is normally carried by the riflemen 1 in a case. The case can be rigid with storage supports, or of a zipper canvas bag, or other convenient container. This is one of the many advantages of the subject rod assembly 10 since it can be disassembled for carrying, as shown in FIG. 10 even in a knapsack worn by the rifleman.

Prior to use, the various rod portions and their respective couplers are cleaned to make sure that the female and male threads will engage readily. They are subsequently assembled in no particular order, other than that dictated by the ultimate length of the rod assembly 10 to be utilized by the rifleman 1.

When utilized as an extractor, the slide 25 is normally vertically oriented along the slide rod 20 and dropped repeatedly until the impact causes the bullet extractor 14 to enter into the bullet. At this point the rod assembly 10 is rotated to the right and further positions the bullet extractor 14 in the bullet 3. Thereafter, the bullet can be removed by raising the slide 25 to impact the slide stop 26. When utilized as a swab, such as shorn in FIG. 9, the swab 16 is secured to the swab holder 29 which, in turn, is secured to the accessory coupler/bullet seater 12.

Another aspect of the invention looks to tamping the bullet 3 on top of the powder charge 5 and its associated wadding 4 (if the latter is used). Normal powder is measured and poured into the rifle 2 by the rifleman 1. Pyrodex powder or black poweder may be employed. The importance of the invention relates to tamping. Uniform tamping means improved uniform muzzle velocity which, in turn, translates into a tighter cluster at the strike zone. The number of drops for the slide 25 is determined empirically by the rifleman. For some it may be four drops, for some six or eight. By "drop" it is meant that this is the number of times that the slide 25 is raised on the slide rod 20 to the slide stop 26, and thereafter dropped to engage the slide rod coupler 22 which, in turn, transmits the impact through the entire rod assembly to the accessory coupler/bullet seater 12 and the tamper cup 15.

I. Important steps for safety are set forth in several publications, not the least of which are:
   A. Muzzleloading Manual published by the NMLRA.
   B. Shooting Thompson/Center Blackpowder Muzzleloading Firearms published by Thompson/Center Arms Co., Inc.

II. As to the tamping of powder, and its efficacy, attention is directed to:
   A. Handguns, Dick Metcalf, Shooting Times Magazine, February 1996, page 26, paragraph 4.
   B. Black Powder Loading Manual, 3rd Edition, Sam Fadala, The Gun Digest, 1995, Chapter 10, page 82.
   C. Longshots, Thomas McIntyre, Sports Afield, February 1997, page 29.
   D. Pelletized Propellant, Guy Chancy, Field & Stream, February 1997, page 34.
   E. Reloading for Shotgunners, Edward Matunas, 3rd Edition, pages 43 and 71.
   F. Definition from Webster's Third New International Dictionary of the English Language Unabridged, page 2336.
   G. Shooting Thompson/Center Blackpowder Muzzleloading Firearms, published by Thompson/Center Arms Co., Inc. pages 31–33, 37, 54, 59.

III. Finally, as to the various accessories that are available, they can be exemplified in:
   A. Cabela's 1996 Master Fall Catalog, pages 402 and 403.
   B. Jas Townsend & Son, Inc., Catalog No. 16, 1996—Spring '97, page 54.

IV. Catalogues identifying the various accessories that can be employed include:
   A. Cabela's 1996 Master Fall Catalog, pages 402 and 403.
   B. Black Powder Loading Manual, 3rd Edition, Sam Fadala, The Gun Digest, 1995, Manufacturers' Directory.

V. The subject matter of tamping the bullet and the powder and the importance of uniformity and consistency, is set forth in:
   A. Handguns, Dick Metcalf, Shooting Times Magazine, February 1996, page 26, paragraph 4.
   B. Black Powder Loading Manual, 3rd Edition, Sam Fadala, The Gun Digest, 1995, Chapter 10, page 82.
   C. Longshots, Thomas McIntyre, Sports Afield, February 1997, page 29.
   D. Pelletized Propellant, Gary Chancy, Field & Stream, February 1997, page 34.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A rod assembly for utilization in a muzzle loading firearm comprising, in combination, an accessory rod threaded at each end, an accessory coupler for threadedly engaging the accessory rod, an extension coupler for securement to the accessory rod having means for threadedly engaging an accessory rod coupler, a coupler to secure the extension rod to a slide rod, and a slider adjustably secured to the slide rod and slidable axially along the slide rod for impacting the rod assembly by dropping the same onto the coupler securing the slide rod to the balance of the rod assembly.

2. In the rod assembly of claim 1 above, said slider having means for securing a stop thereto, and a means for securing the slide to the slide rod for securing the same along the slide rod.

3. A method for securing accessories to a ramrod for engagement with a muzzle loading firearm comprising the steps of:

providing a rod assembly which is sequentially assembled including an accessory rod, and slide rod with the accessory rod proportioned to achieve the ultimate length of the rod needed, forming a slide to slide along the slide rod with sufficient mass to drop the same and impact the rod assembly toward the breech end of the muzzle loader bore, securing the subject rods through couplers each to the other and axially in alignment, securing the slide to the slide rod, positioning the rod assembly interiorly of the muzzle of a muzzle loaded firearm, engaging the rod assembly by manipulating the slide, and securing the appropriate accessory to the far end of the rod for engaging the interior portion of the rifle.

4. In the rod assembly of claim 3 above, said slider having means for removably securing the same to the slide rod to thereby avoid shaking and rattling in the transport configuration.

5. A firearm servicing rod assembly for use in a muzzle loading firearm comprising, in combination, an accessory rod, means for removably securing said rod to another element at each end thereof, an accessory coupler for engaging the accessory rod, said accessory coupler having removable securing means at the accessory rod engaging member end, an extension coupler for securement to the accessory rod having removable securing means for engaging the accessory rod coupler, a further coupler to secure the extension rod to a slide rod, and a slider slidably movable and adjustably secured to the slide rod, whereby the slider can be dropped onto the coupler securing the slide rod to the balance of the rod assembly to thereby provide an impact loading to the rod for impactingly engaging the accessory end of the rod.

6. A rod assembly for utilization in a muzzle loading firearm comprising, in combination, a rod proportioned to slide interiorly of the firearm and having a length to engage the bullet chamber at one end and extend from the muzzle at the other end, an accessory coupler for securement to the accessory rod at that end closest to the bullet chamber, a slide rod having means for removably securing the same to the accessory rod at the end opposite the bullet chamber, a slider proportioned to surround the slide rod and slide axially along the slide rod, and stop means at the end remote from the bullet chamber on the rod for impacting the slider, whereby raising and permitting free-fall of the slider onto the slide rod stop will provide uniform and consistent kinetic loading onto the rod and therefore permit the rifleman to develop his own empirical number of drops of the slider to ensure consistency of tamping and upgrade the consistency of the target cluster.

7. In the rod assembly of claim 6, said accessory coupler having a cup at its accessory engaging end.

* * * * *